United States Patent [19]

Sjöstrand

[11] 4,205,457

[45] Jun. 3, 1980

[54] CONDENSATE SCAVENGING APPARATUS

[76] Inventor: Nils-Eric Sjöstrand, Svensköp 3-22, S-242 00 Hörby, Sweden

[21] Appl. No.: 18,619

[22] Filed: Mar. 8, 1979

[51] Int. Cl.[2] ..... F26B 13/18

[52] U.S. Cl. ..... 34/43; 34/124; 34/125; 165/40; 165/90; 165/96; 165/111

[58] Field of Search ..... 34/43, 48, 49, 54, 119, 34/124, 125; 137/204; 165/40, 90, 96, 111; 432/60, 228; 219/469

[56] References Cited

U.S. PATENT DOCUMENTS

| | | | |
|---|---|---|---|
| 220,243 | 10/1879 | Jamison | 34/124 |
| 2,869,248 | 1/1959 | Justus | 34/54 |
| 3,721,016 | 3/1973 | Lee et al. | 34/125 |

FOREIGN PATENT DOCUMENTS

| | | | |
|---|---|---|---|
| 600284 | 7/1934 | Fed. Rep. of Germany | 34/119 |
| 354038 | 11/1972 | U.S.S.R. | 34/124 |

*Primary Examiner*—William E. Wayner
*Assistant Examiner*—Harold Joyce
*Attorney, Agent, or Firm*—B. P. Fishburne, Jr.

[57] ABSTRACT

An apparatus for scavenging condensate from the interior of a cylinder, such as a drying cylinder of a papermaking machine, which is heated by means of condensable medium. The apparatus comprises a siphon arranged in the cylinder and forming a mainly radial passage. One end of the passage opens in the vicinity of the inner circumferential surface of the cylinder while the other end of the passage is in communication with a condensate scavenging pipe which extends along the cylinder axis and is in communication with a region outside the cylinder to scavenge condensate from the interior of the cylinder. The passage formed by the siphon is composed of a plurality of parallel and mutually delimited part passages. A pressure difference sensing means is arranged in the cylinder to sense the difference between the pressure in the cylinder and respectively a pressure depending upon the pressure drop in the siphon and a preset reference pressure. A control means is disposed in the cylinder to control the size of the cross-sectional area of the passage by blocking a number of part passages which is dependent upon the pressure difference sensed by the pressure difference sensing means, and is connected to the pressure difference sensing means so that it enlarges the cross-sectional area of the passage at a pressure increase in the cylinder and/or a pressure drop increase in the siphon, and reduces the cross-sectional area of the passage at a pressure decrease in the cylinder and/or a pressure drop decrease in the siphon.

4 Claims, 4 Drawing Figures

CONDENSATE SCAVENGING APPARATUS

This invention relates to an apparatus for scavenging condensate from the interior of a cylinder, such as a drying cylinder of a paper-making machine, which is heated by means of a condensable medium, said apparatus comprising a siphon arranged in the cylinder and forming a substantially radial passage, one end of which opens in the vicinity of the inner circumferential surface of the cylinder while the other end of the passage is in communication with a condensate scavenging pipe which extends along the cylinder axis and is in communication with a region outside the cylinder to scavenge condensate from the interior of the cylinder.

Prior art apparatuses for scavenging condensate from rotary cylinders, such as the drying cylinders utilized in the paper and textile industries, mainly are of two kinds, i.e. scoop type apparatuses and siphon type apparatuses. The scope type apparatuses include scoops and make use of the torque motor effect of the cylinder to bail out condensate from the cylinder. The siphon type apparatuses include siphons and exploit the pressure of the condensable medium, usually steam, to scavenge condensate from the cylinder.

The present invention relates to a siphon type apparatus which is exploited for scavenging condensate from rotary or stillstanding cylinders. The siphon is arranged in the cylinder in form of a pipe which scavenges condensate collecting in the cylinder. To optimize the function of the siphon, i.e. of the condensate scavenging procedure, the dimensions of the siphon, particularly the cross-sectional area thereof, must be adaped to the medium pressure and to the condensate and medium flows in the cylinder in which the siphon shall be arranged. The medium pressure varies with different types of cylinder arrangements but can also vary for one and the same cylinder in dependence on the desired medium inlet pressure and the pressure drop in the siphon, which is caused by the condensate and medium flows. A pipe dimension selected for a given cylinder thus is only optimal for one of the medium pressures that may prevail.

The object of the present invention is to provide a siphon type apparatus for condensate scavenging, in which the cross-sectional area of the siphon is automatically varied so that the function of the siphon will always be optimal. This means that the pressure drop in the siphon is kept at a substantially constant and as low a value as possible to minimize unnecessary energy losses. The flow through the siphon is proportional to the rate of flow and to the cross-sectional area of the siphon. The pressure drop in the siphon is proportional to the square of the flow rate. At increased flow, the flow rate increases if the cross-sectional area is constant, which implies a heavy increase of the pressure drop and thus of the energy losses. If a siphon has a constant cross-sectional area which has been calculated for a given normal flow, it may be difficult at a small amount of flow to maintain a pressure drop sufficient to overcome the flow resistance of the condensate and thus to scavenge the condensate. In such cases the cross-sectional area of the siphon must therefore be selected so small that high flow rates are attained in the siphon at large flow amounts. This results in large pressure drops and, as a consequence, large energy losses.

The object of the present invention therefore is to provide, at flow variations, such changes in the cross-sectional area of the siphon that the flow rate and thus the pressure drop remain substantially constant. To this end, the siphon constitutes a passage which is composed of several parallel and mutually delimited part passages which are blocked by control means in such a way that the cross-sectional area of the siphon is changed and "follows" the flow variations so that the flow rate and thus the pressure drop in the siphon remain substantially constant.

The invention will now be described in greater detail with reference to the accompanying drawings in which:

FIG. 1 shows part of a rotary drying cylinder 1 which is heated with steam.

Figures 1, 2:
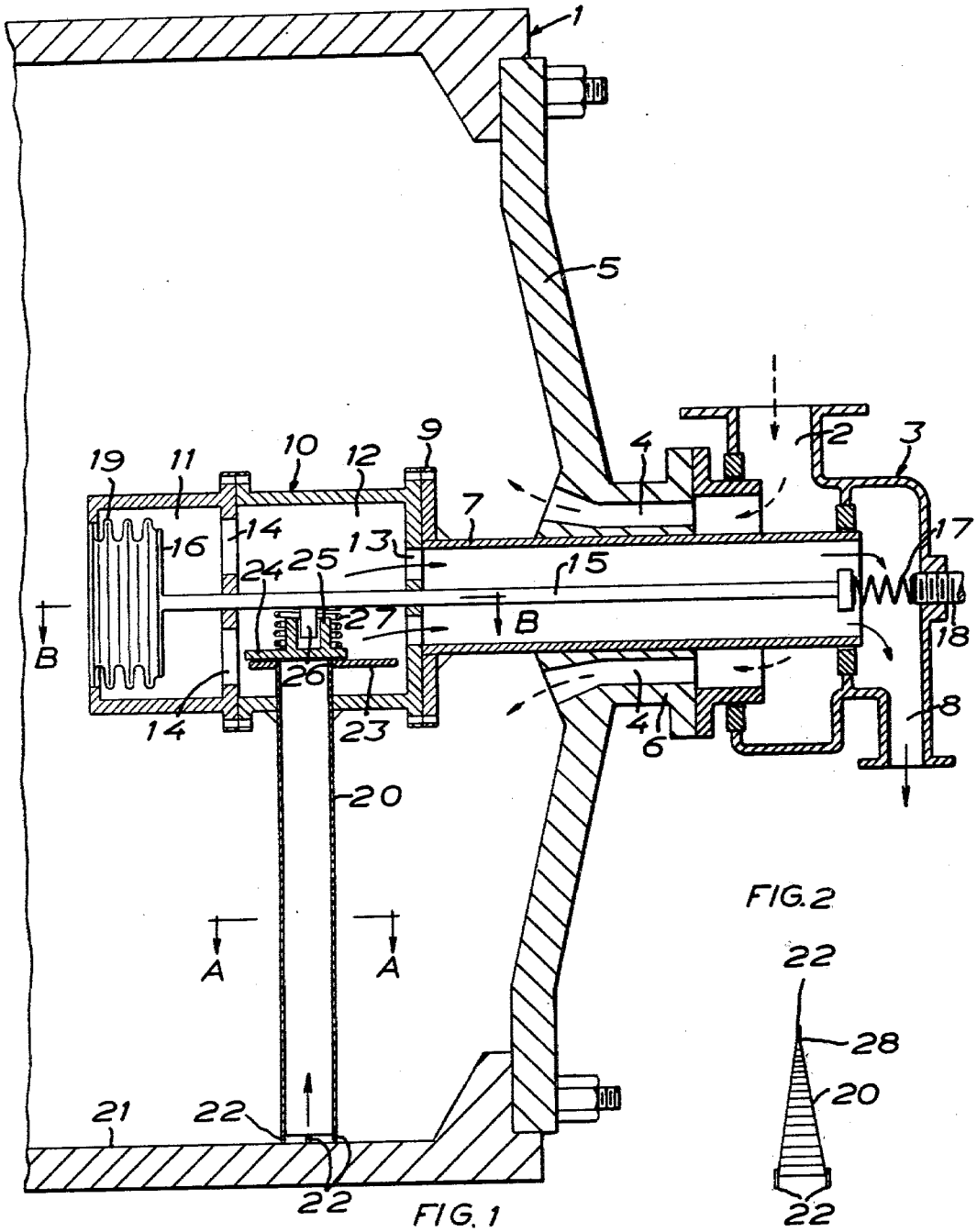
FIG. 1 is a section of part of a drying cylinder having an apparatus according to the invention.
FIG. 2 is a section on line A—A in FIG. 1 of a siphon in said apparatus.
Figure 3:
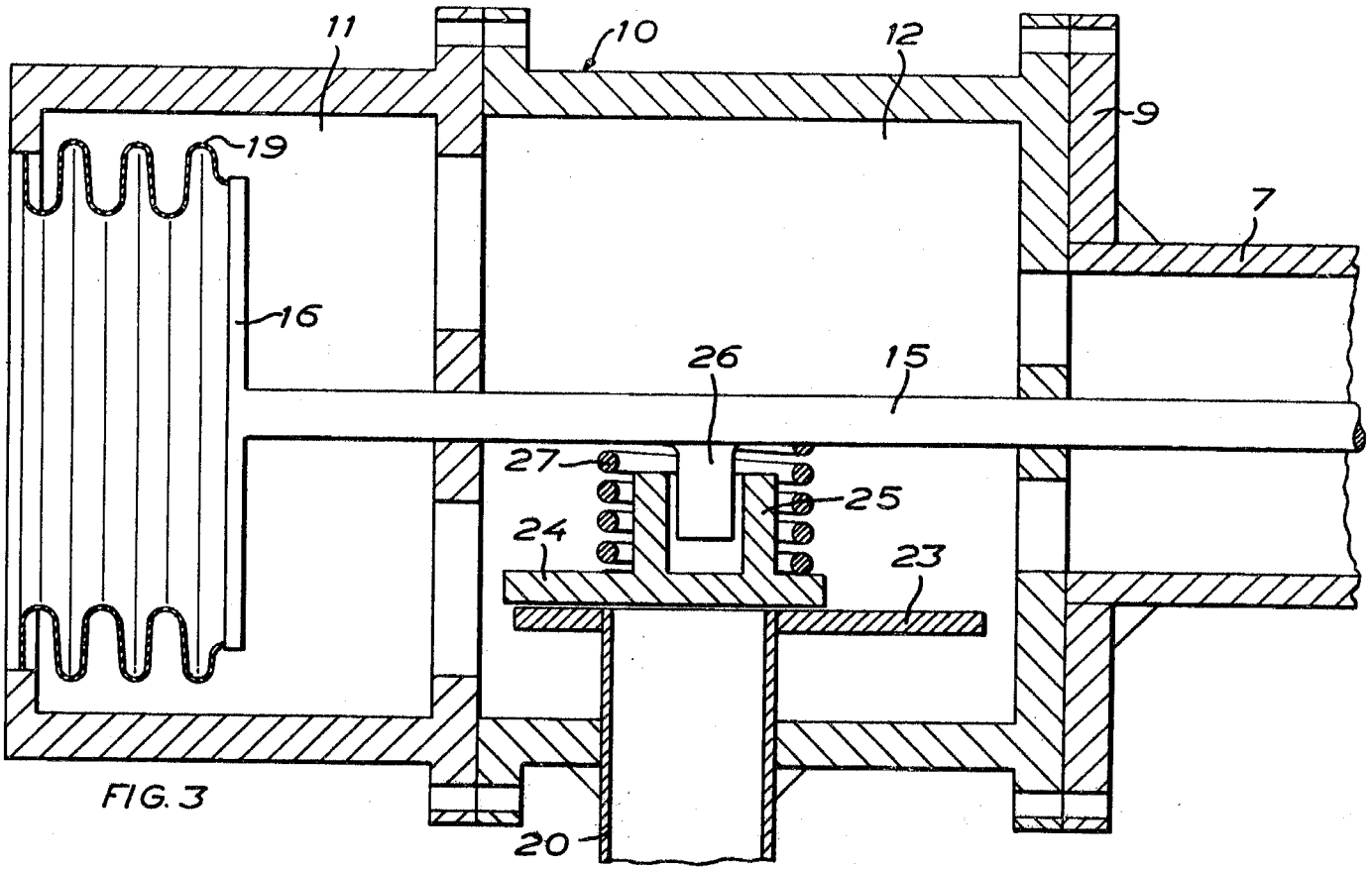
FIG. 3 shows part of the apparatus on a larger scale.

The steam is introduced into the cylinder 1 via an inlet 2 of a stationary outer housing 3 and passages 4 in an axle journal 6 formed on one end wall 5 of the cylinder 1, as shown by broken line arrows. The axle journal 6 extends sealingly into the outer housing 3.

An axially directed condensate scavenging pipe 7 about which the cylinder 1 is rotatable or which is rotatable with the cylinder 1, extends from the interior of the cylinder 1 sealingly through the axle journal 6 and opens into a condensate outlet 8 in the outer housing 3. The outlet 8 is delimited from the inlet 2. At the inner end the condensate scavenging pipe 7 has a flange 9 on which an inner housing 10 is fixed. The inner housing 10 is divided into two communicating chambers 11, 12. The chamber 12 is in communication via passages 13 with the condensate scavenging pipe 17 and via passages 14 with the chamber 11.

An axially directed spindle 15 extends through the condensate scavenging pipe 7 and the chamber 12 and opens into the chamber 11. At the inner end the spindle 15 carries a disk 16 which is housed in the chamber 11, and at the other end it is actuated by a pressure spring 17 disposed between the spindle end and a set screw 18 in the outer housing 3. The set screw 18 can be replaced for instance with a hydraulically operated means which permits remote control of the pressure force of the pressure spring 17. A bellows 19 is fixed to the disk 16 and to the inner housing 10 so that the bellows and the disk together delimit the chamber 11 from the interior of the cylinder 1.

A radially directed siphon 20 extends from the inner circumferential surface 21 of the cylinder 1 into the chamber 12. In a known manner not shown in detail the outer end of the siphon 20 constitutes a dynamically conformed nozzle and is kept spaced from the circumferential surface 21 by fins 22. Condensate collecting in the cylinder 1 is taken up by the siphon 20 because of the arising pressure difference and is scavenged via the inner housing 10, the condensate scavenging pipe 7 and the condensate outlet 8, as is shown by full line arrows in FIG. 1.

A table 23 is disposed about the inner end of siphon 20 and forms flush with said end a sliding surface for a control slide 24 which is disposed on the table 23. The control slide 24 has an upwardly directed annular flange 25 in which a pin 26 of the spindle 15 engages. The control slide 24 is pressed down against the table 23 by means of a spring 27 between the spindle 15 and the control slide 24.

Figure 4:
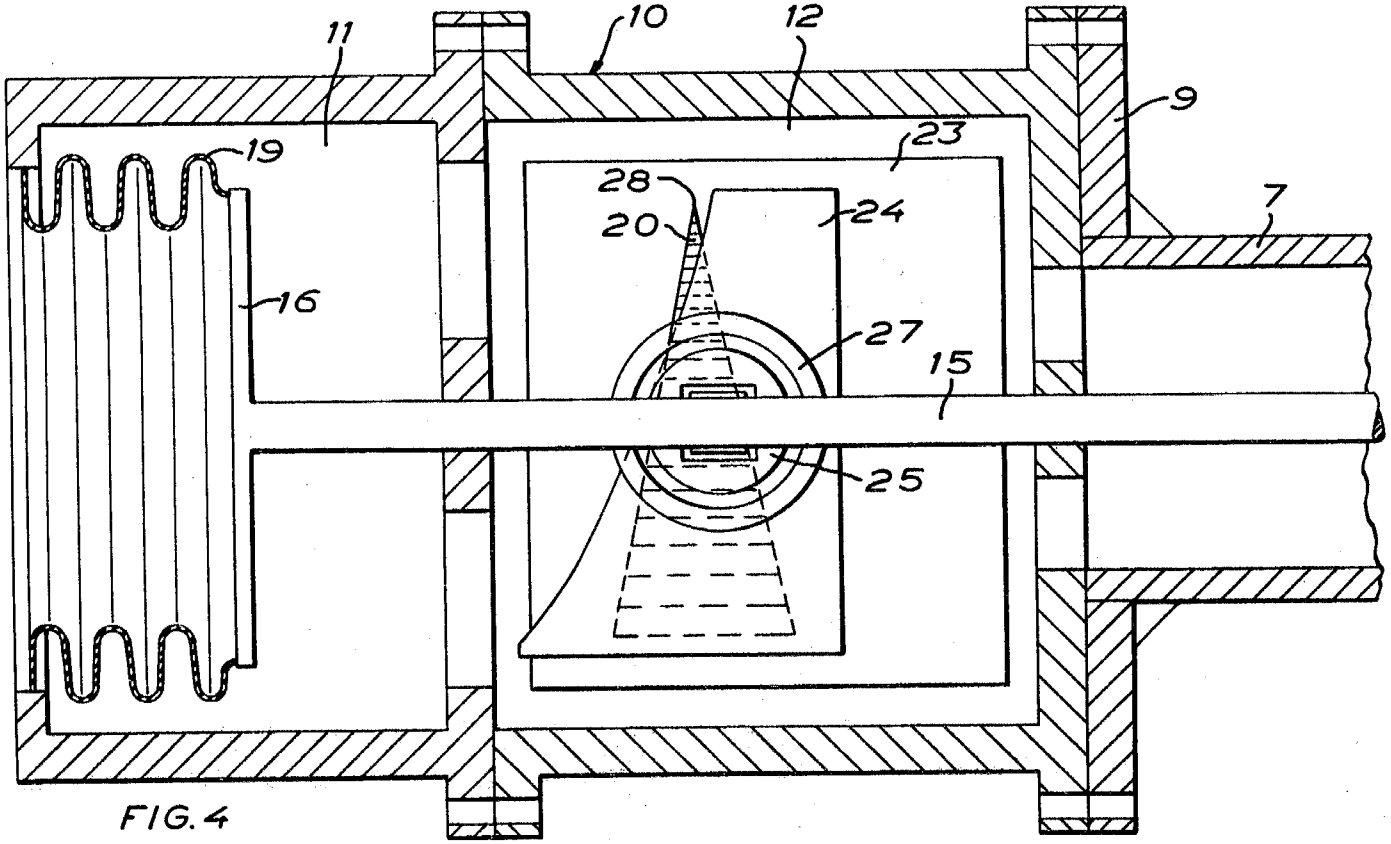
FIG. 4 is a section on line B—B in FIG. 1 and on a larger scale of part of the apparatus.

As will appear from FIGS. 2 and 4, the siphon 20 in the embodiment illustrated is of triangular cross-section, having a pointed end 28. The passage formed by the siphon 20 is composed of several parallel and mutually delimited part passages. The edge of the control slide 24 facing the bellows 19 is of such an extension horizontally and the siphon 20 is so disposed that the control slide 24 when sliding over the table 23 towards the right in the drawings opens the part passages of the siphon 20 in turn of order from the pointed end 28 of the cross-section. The cross-sectional area of the siphon 20, which is available for condensate scavenging, thus successively increases as the control slide 24 moves to the right. When the control slide moves in the opposite direction there of course occurs a corresponding successive reduction of said area.

When the drying cylinder 1 is in operation and steam under pressure is supplied thereto condensate gradually collects in the cylinder. The steam pressure in the cylinder 1 is balanced via the bellows 19 and the disk 16 by the pressure on the condensate side, i.e. the pressure prevailing in the chambers 11 and 12, and by the counterpressure which is preset by means of the set screw 18 and the spring 17. In this state of balance the control slide 24 keeps a certain cross-sectional area of the siphon 20 open. If the steam pressure in the drying cylinder 1 increases or the pressure drop in the siphon 20 increases, the spindle 15 is moved to the right until the pressure on the condensate side and the spring pressure again balance the steam pressure. In this new state of balance the control slide 24 keeps a large cross-sectional area of the siphon 20 open.

The apparatus according to the invention thus provides an automatic control of the cross-sectional area as a function of the steam pressure and the pressure drop in the siphon 20, said area, as is desirable, being increased at increasing steam pressure or increasing pressure drop in the siphon.

What I claim and desire to secure by Letters Patent is:

1. Apparatus for scavenging condensate from the interior of a cylinder (1), such as a drying cylinder of a paper-making machine, which is heated by means of a condensable medium, said apparatus comprising a siphon (20) arranged in the cylinder and forming a mainly radial passage, one end of which opens in the vicinity of the inner circumferential surface of the cylinder while the other end of the passage is in communication with a condensate scavenging pipe (7) which extends along the cylinder axis and is in communication with a region outside the cylinder to scavenge condensate from the interior of the cylinder, characterized by the fact that the passage formed by the siphon (20) is composed of several parallel and mutually delimited part passages, that a pressure difference sensing means (19) is arranged in the cylinder (1) to sense the difference between the pressure in the cylinder (1) and respectively a pressure depending upon the pressure drop in the siphon (20) and a preset reference pressure, and that a control means (24) is disposed in the cylinder (1) to control the size of the cross-sectional area of the passage by blocking a number of part passages, which is dependent upon the pressure difference sensed by the pressure difference sensing means (19), and is connected to the pressure difference sensing means (19) so that it enlarges the cross-sectional area of the passage at a pressure increase in the cylinder (1) and/or a pressure drop increase in the siphon (20), and reduces the cross-sectional area of the passage at a pressure decrease in the cylinder and/or a pressure drop decrease in the siphon.

2. Apparatus as claimed in claim 1, characterized in that the control means is a control slide which closely bears against the end surface of the siphon (20) facing away from the inner circumferential surface (21) of the cylinder (1), said control slide being movable along said end surface.

3. Apparatus as claimed in claim 2, characterized in that the end of the siphon (20) facing away from the inner circumferential surface (21) of the cylinder (1) opens into a housing (10) in the cylinder (1), said housing being in communication with the region outside the cylinder (1) via a condensate scavenging pipe (7) arranged concentrically with the axis of the cylinder (1), and that the pressure difference sensing means is a bellows (19) which forms a partition between the inner side and outer side of the housing (10) and which is coupled to the control slide (24) via a spindle (15) movably disposed in the housing (10).

4. Apparatus as claimed in claim 3, characterized in that the spindle (15) at one end is connected to the bellows (19) at the other end actuated by an adjusting spring (17) for controlling the reference pressure.

* * * * *